US011686324B1

(12) United States Patent
Tang

(10) Patent No.: US 11,686,324 B1
(45) Date of Patent: Jun. 27, 2023

(54) STATOR STRUCTURE AND MOTOR

(71) Applicant: Dongguan Kede Precision Manufacturing Co., Ltd., Dongguan (CN)

(72) Inventor: Youwei Tang, Dongguan (CN)

(73) Assignee: DONGGUAN KEDE PRECISION MANUFACTURING CO., LTD., Dongguan (CN)

( * ) Notice: Subject to any disclaimer, the term of this patent is extended or adjusted under 35 U.S.C. 154(b) by 0 days.

(21) Appl. No.: 17/902,727

(22) Filed: Sep. 2, 2022

(30) Foreign Application Priority Data

May 6, 2022 (CN) ..... 202221066709.8

(51) Int. Cl.

| | |
|---|---|
| ***F04D 29/54*** | (2006.01) |
| ***F04D 25/08*** | (2006.01) |
| ***F04D 29/64*** | (2006.01) |
| ***F04D 19/00*** | (2006.01) |

(52) U.S. Cl.
CPC ..... *F04D 29/547* (2013.01); *F04D 19/002* (2013.01); *F04D 25/08* (2013.01); *F04D 29/644* (2013.01); *F05D 2240/14* (2013.01)

(58) Field of Classification Search
CPC ..... F04D 19/002; F04D 25/06; F04D 25/08; F04D 29/547; F04D 29/644
See application file for complete search history.

(56) References Cited

U.S. PATENT DOCUMENTS 2,488,945 A * 11/1949 Troller ..... F04D 19/002 D23/370
2,956,731 A * 10/1960 Bayuk ..... F04D 19/002 417/423.14

FOREIGN PATENT DOCUMENTS

CN 110657118 A * 1/2020 ..... F04D 19/002
FR 2728027 A1 * 6/1996 ..... F04D 19/002

* cited by examiner

*Primary Examiner* — Sabbir Hasan
*Assistant Examiner* — Jackson N Gillenwaters
(74) *Attorney, Agent, or Firm* — Zhigang Ma

(57) ABSTRACT

A stator structure and a motor are provided, including an air duct housing. A fixing part is coaxially disposed in the air duct housing and configured to install a motor assembly, connecting components disposed between the air duct housing and the fixing part fix a relative position between the air duct housing and the fixing part, a position of a mounting inlet of the fixing part is on the same side as a position of a fan blade assembly of the air duct housing, an end of the fixing part far away from the mounting inlet is provided with a mounting end cover. By setting the mounting inlet of the fixing part and the fan blade assembly of the air duct housing on the same side, processing of surfaces A, B and C can be completed by one processing without secondary processing, therefore ensuring coaxiality and accuracy of the processing.

16 Claims, 5 Drawing Sheets

STATOR STRUCTURE AND MOTOR

TECHNICAL FIELD

The disclosure relates to a technical field of driving devices, in particular to a stator structure and a motor.

BACKGROUND

When a motor rotates at a high speed, there are very strict requirements on coaxiality among fan blades, a rotor, an air duct, bearings, and bearing chocks in the motor. Poor coaxiality will lead to the generation and expansion of the vibration noise of the motor and affect the service life of the motor. At present, the motor used in the ventilation duct includes an air duct and a necessary motor assembly installed in the air duct. In order to ensure the coaxial consistency between the air duct and the motor assembly, an inner wall of the air duct needs to be processed. In an existing motor processing and assembly process, the fan blades, the stator and the rotor can be assembled at the same time on both sides of the air duct, which can improve the assembly efficiency; however, the coaxiality among the fan blades, the rotor, the stator and an air duct housing is difficult to be achieved by the assembly, and processing accuracy of the inner wall of the air duct is relatively low. At present, a high speed rotation of the motor requires higher coaxial consistency and more accurate processing. The processing accuracy of the prior art can no longer meet the high requirements for the motor assembly. An existing air duct is shown in FIG. 1 to FIG. 3, smooth machining of surfaces A', B', C', and D' of inner walls of the air duct is required, but an end cover 1' of the air duct is disposed near an air inlet of the air duct, result in separating the surface A' from the surfaces B', C', and D', therefore secondary processing is required which results in the coaxiality cannot be guaranteed.

SUMMARY

A purpose of the disclosure is to provide a stator structure and a motor to solve technical problems described in above background.

To achieve the above purpose, the disclosure provides a technical scheme described below.

A stator structure, including an air duct housing, a fixing part, connecting components, and a mounting end cover. The fixing part is coaxially disposed in the air duct housing and configured to install a motor assembly, the connecting components are disposed between the air duct housing and the fixing part, the connecting components are configured to fix a relative position between the air duct housing and the fixing part, a position of a mounting inlet provided by the fixing part is on a same side as a position of a fan blade assembly disposed in the air duct housing, an end of the fixing part far away from the mounting inlet is provided with the mounting end cover.

A motor, including the stator structure described above. The motor further includes the motor assembly and the fan blade assembly, the motor assembly is disposed in the fixing part, an output end of the motor assembly is provided with the fan blade assembly, the fan blade assembly includes arcuate fan blades and a fan blade housing, and the fan blade assembly is disposed in the air duct housing.

The disclosure has following beneficial effects.

1. By setting the mounting inlet provided by the fixing part and the fan blade assembly disposed in the air duct housing on a same side, processing of surfaces A, B and C can be completed by one processing without secondary processing, therefore ensuring coaxiality of the air duct.

2. Since a position of the mounting inlet provided by the fixing part and a position an air inlet provided by the air duct housing are on the same side, a front end cover needs to be installed, and an installation position of the front end cover corresponds to the surface B. Therefore, the disclosure does not need to process the surface D' surface existed in the existing air duct, therefore reducing processing steps and improving the processing efficiency and accuracy of processing coaxiality.

Other features and advantages of the disclosure will be explained in detail in specific embodiments.

DESCRIPTION OF REFERENCE NUMERALS

Figure 1:
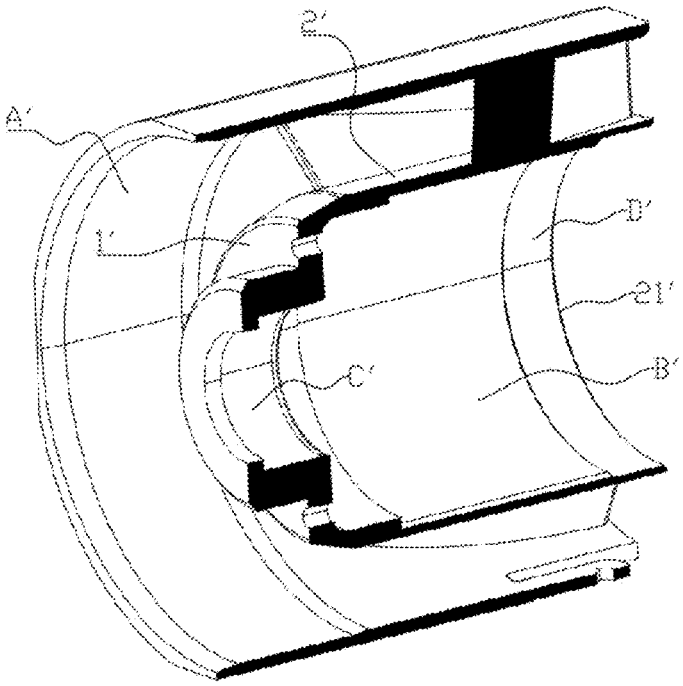
FIG. 1 (Prior art)
FIG. 1 is a sectional three-dimensional schematic view of an air duct housing in the prior art.

1—air duct housing, 2—fixing part, 21—mounting inlet, 22—positioning groove, 3—mounting end cover, 31—escape hole, 4—air deflector, 5—reinforcing rib, 6—motor assembly, 61—protrusion, 62—front end cover, 7—fan blade assembly, 71—arcuate fan blade, 72—fan blade housing, 8—bearing.

DETAILED DESCRIPTION OF EMBODIMENTS

In the following, technical schemes in the embodiments of the disclosure will be clearly and completely described in combination with figures in the embodiments of the disclosure.

Please refer from FIG. 4 to FIG. 9.

The disclosure improves on a defect that the coaxial consistency of an air duct in the prior art cannot be guaranteed, the disclosure specifically includes an air duct housing 1 and a fixing part 2, the fixing part 2 is coaxially disposed in the air duct housing 1 and configured to install a motor assembly 6. An air duct of the disclosure differs from the prior art is described below. An end of the fixing part 2 far away from a mounting inlet 21 is provided with a mounting end cover 3, there is no barrier among surface A of an inner wall of the air duct housing 1, surface B of an inner wall of the fixing part 2 and surface C of an inner wall of the mounting end cover 3; the three surfaces are set on a same side while the three surfaces are coaxial surfaces, where the surface A refers to the inner wall of the air duct housing 1, the surface A can provide an installation position for a fan blade assembly 7, the surface B refers to the inner wall of the fixing part 2, the surface B can provide an installation position for the motor assembly 6, the surface C refers to the inner wall of the mounting end cover 3, the surface C can provide an installation position for a bearing 8. During processing, the processing can be carried out in the order of the surfaces A, B, and C; or in the order of the surfaces C, B, and A; or in other orders, this is not a limitation to the disclosure. It can be determined that the processing of the surfaces A, B and C can be completed by one processing without secondary processing, therefore ensuring coaxiality of the air duct.

Figure 2:
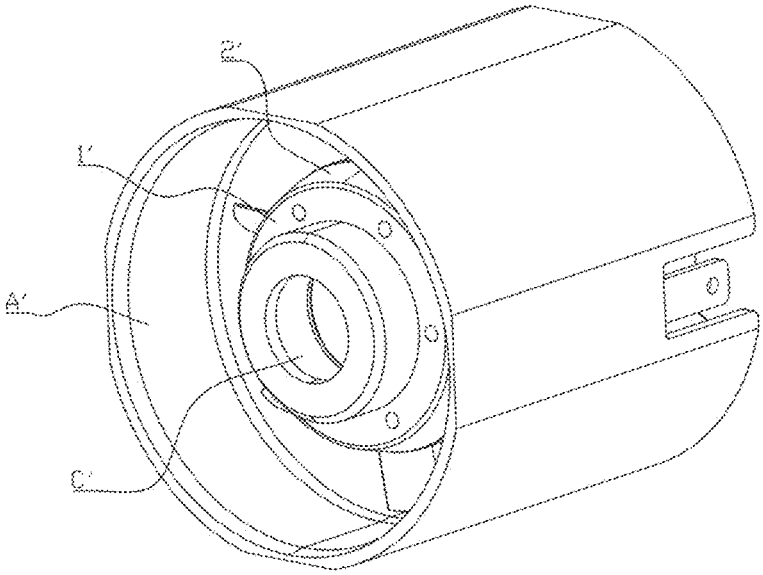
FIG. 2 (Prior art)
FIG. 2 is a three-dimensional structural view I of the air duct housing in the prior art.
Figure 3:
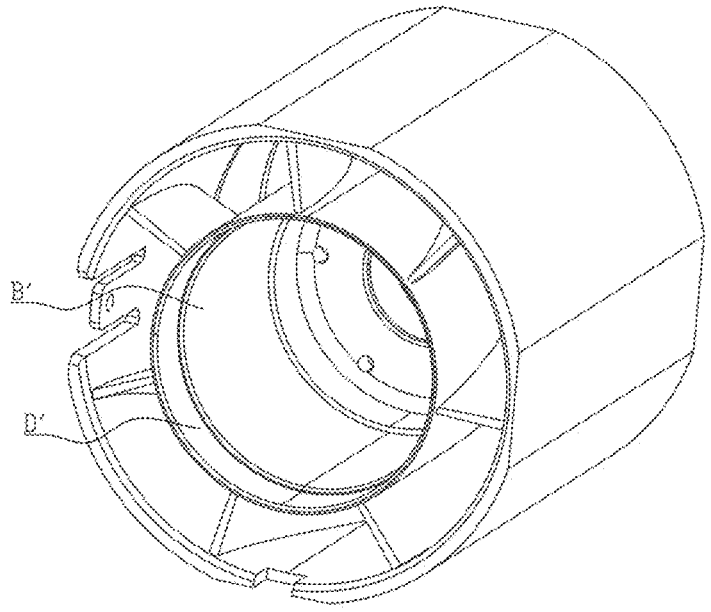
FIG. 3 (Prior art)
FIG. 3 is a three-dimensional structural view II of the air duct housing in the prior art.
Figure 4:
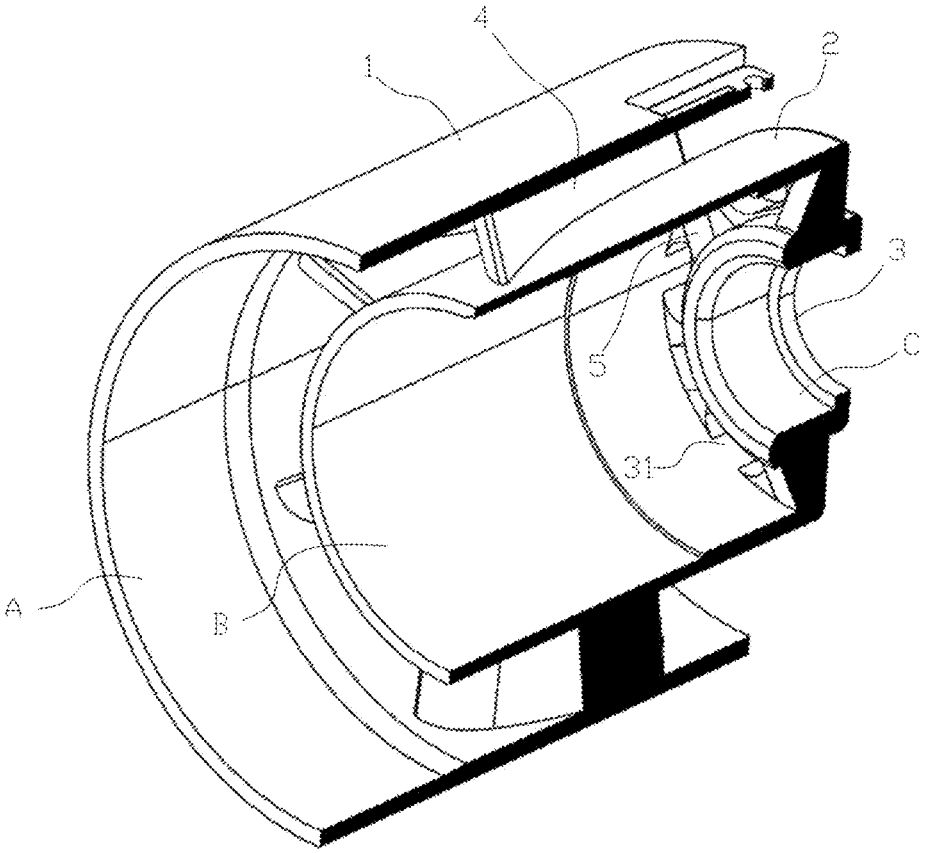
FIG. 4 is a sectional three-dimensional schematic view of an air duct housing of the disclosure.
Figure 5:
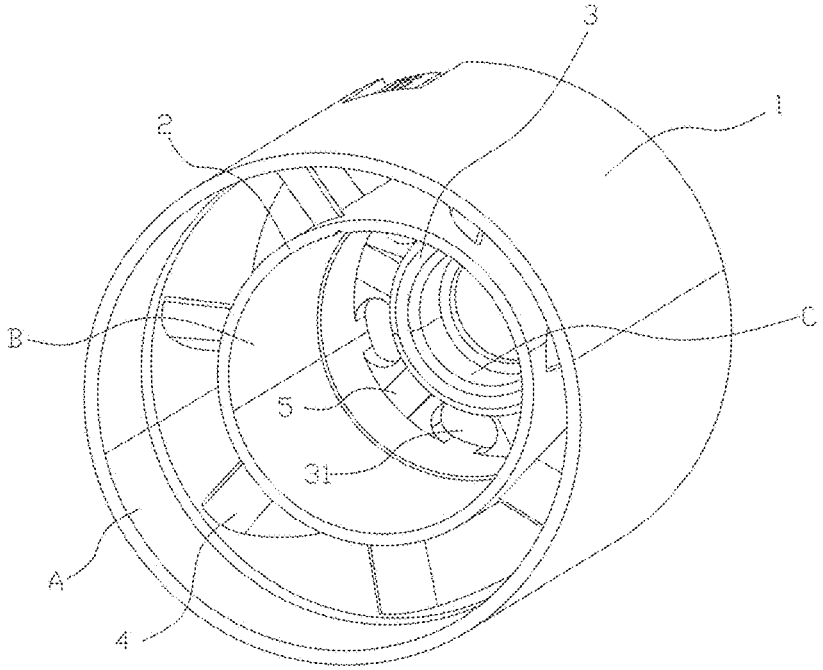
FIG. 5 is a three-dimensional structural view of the air duct housing of the disclosure.
Figure 6:
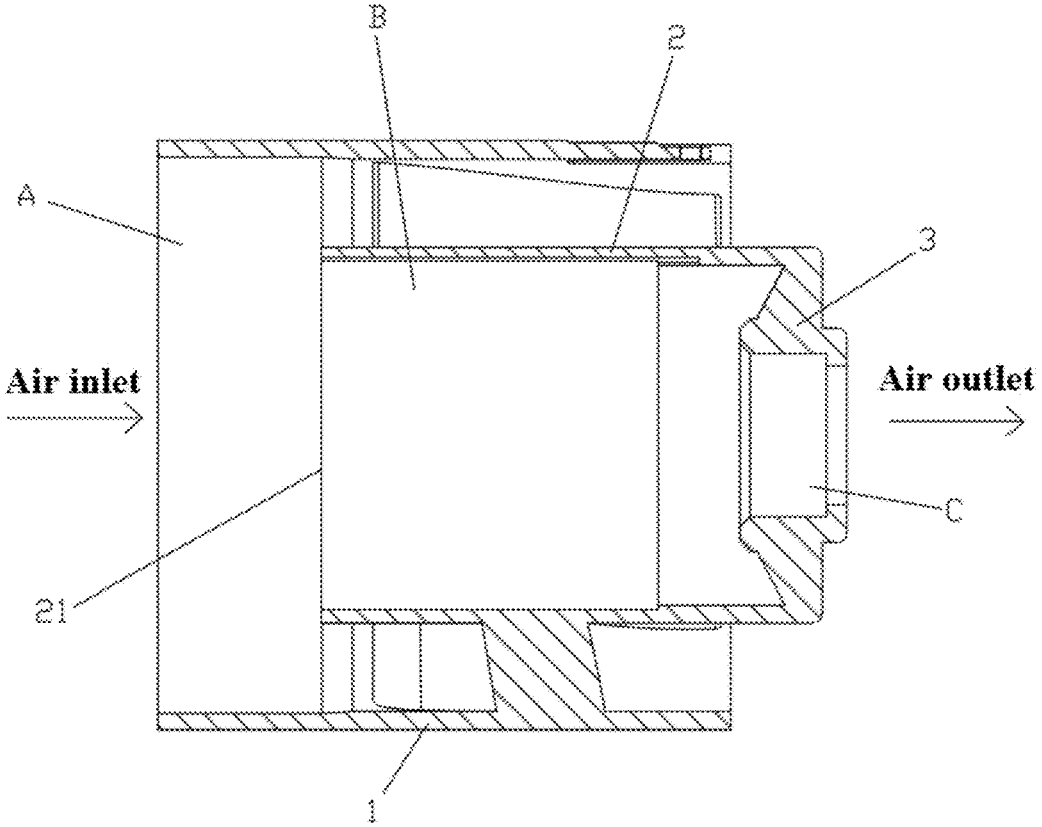
FIG. 6 is a side sectional view of the air duct housing of the disclosure.
Figure 7:
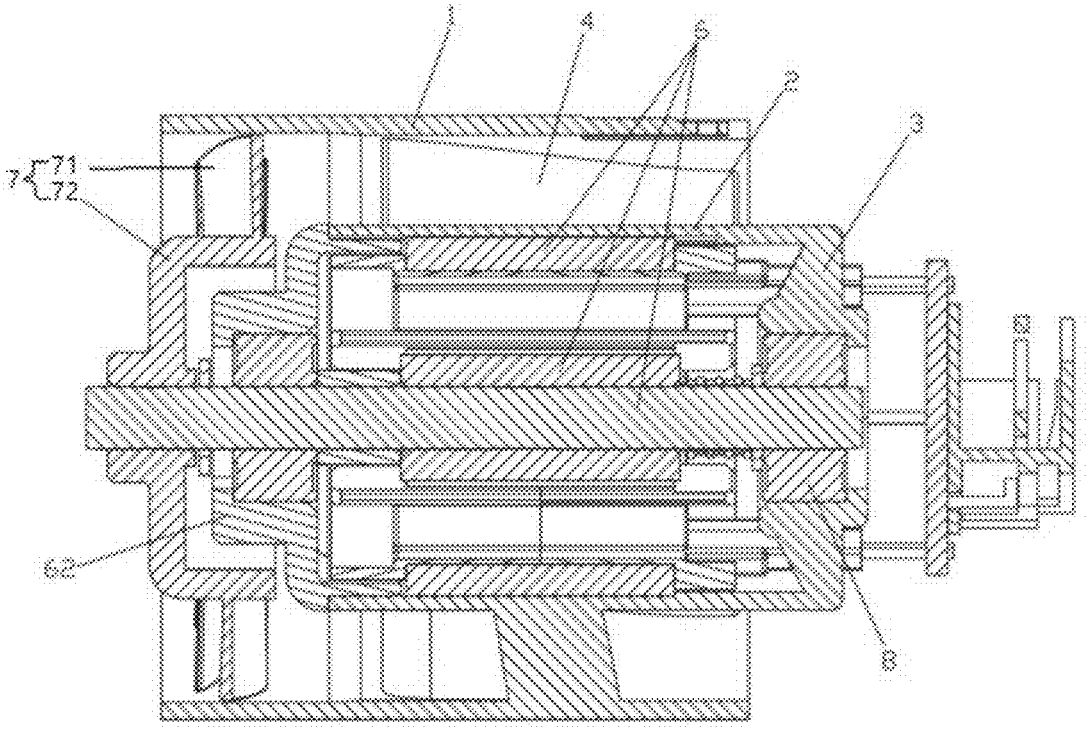
FIG. 7 is a side sectional view of a motor of the disclosure.
Figure 8:
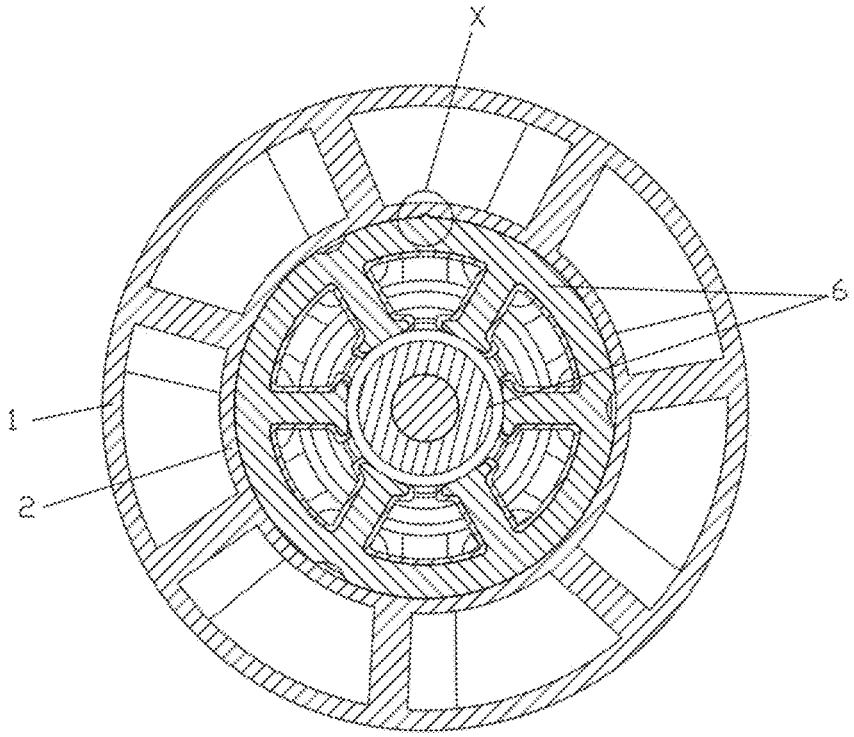
FIG. 8 is a front sectional view of the motor of the disclosure.
Figure 9:
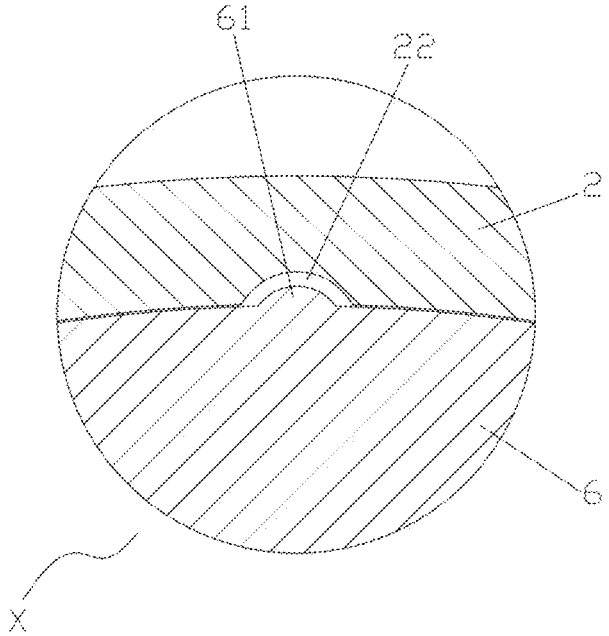
FIG. 9 is an enlarged view of part X in the FIG. 8.

In addition, please refer from FIG. 1 to FIG. 3, in order to improve an efficiency of assembling a motor, a position of a mounting inlet 21' of a fixing part 2' in the prior art deviates from a position A' where fan blades installed in an air duct (not shown in the figures), and a motor assembly can be assembled directly on both sides of the air duct at the same time. The motor assembly generally includes a stator assembly, a rotor assembly and end covers; where the stator assembly is installed in the fixing part 2', the rotor assembly is disposed in the stator assembly and an end of the rotor assembly passes through an end cover 1', another end of the rotor assembly passes through a rear end cover (not shown in the figures), which means that the rear end cover needs to be installed at the mounting inlet 21' of the fixing part 2'. In order to ensure coaxiality of the rear end cover, the surface D' of the fixing part 2' also needs to be processed. Therefore, the secondary processing is required, which reduces the coaxiality compared with one processing.

In the disclosure, since the mounting inlet 21 provided by the fixing part 2 and an air inlet provided by the air duct housing 1 are on the same side, a front end cover 62 needs to be installed, and an installation position of the front end cover 62 corresponds to the surface B. Therefore, the disclosure does not need to process the surface D' existed in the existing air duct. The disclosure reduces processing steps and improves the processing efficiency and accuracy of processing coaxiality.

The air duct of the disclosure needs to be used in conjunction with the motor assembly 6 to form a motor applied in a hair dryer or an air comb. An output end of the motor is provided with the fan blade assembly 7, the fan blade assembly 7 includes arcuate fan blades 71 and a fan blade housing 72, the fan blade housing 1 is configured to fix the arcuate fan blades 71. The fan blade housing 72 is sleeved at a rear end of the motor assembly 6. When the motor drives the fan blade assembly 7 to rotate, external air enters from the air inlet of the air duct through the arcuate fan blades 71 speed up the wind, the air passes through a gap between the air duct housing 1 and the fixing part 2, and then the air is blown out from an air outlet to provide faster and smoother wind, this means that air can form air flow to flow in the air duct by the arcuate fan blades 71 driven by the motor, therefore, a connection between the duct housing 1 and the fixing part 2 is not important. For example, some fixing columns (not shown in the figures) extending in an axial direction are provided on the inner wall of the air duct housing 1. The fixing columns form supports to connect and fix the air duct housing 1 to the fixing part 2. Or air deflectors 4 extending in the axial direction are provided on the inner wall of the air duct housing 1, which can also fix a relative position between the air duct housing 1 and the fixing part 2. In the embodiment, connecting components may be the air deflectors 4 arranged in a circular array to fix the relative position between the air duct housing 1 and the fixing part 2, shapes of the air deflectors 4 are arc respectively, and the air deflectors 4 are oriented in a same direction, which can achieve a good fixing effect and guide the air flow to improve the air outflow effect.

Refer from FIG. 4 to FIG. 9, the fixing part 2 is configured to provide a space to install the motor assembly 6, the stator assembly in the motor part 6 are in direct contact with the inner wall of the fixing part 2. At present, the stator assembly and the fixing part 2 are mostly fixed by screws, which not only requires drilling on the fixing part 2, but also is troublesome to install. In the embodiment, at least one positioning groove 22 extending in the axial direction is provided on the inner wall of the fixing part 2, while a bar-shaped protrusion 61 corresponding to the positioning groove 22 is provided on an outer wall of the stator assembly. During installation, rotating the stator assembly to align the bar-shaped protrusion 61 to the positioning groove 22, then pushing the bar-shaped protrusion 61 along a direction of the positioning groove 22 by hand or other assembly tools, and the bar-shaped protrusion 61 is inserted into the fixing part 2; that is, the bar-shaped protrusion 61 is only needed to be snapped into the positioning groove 22. In addition, the motor assembly 6 also includes the front end cover 62, which is installed behind the fixing part 2, through combination of the front end cover 62 and the mounting end cover 3, a position of the stator assembly is limited and a fixing effect of the stator assembly can be achieved.

Due to the fixing method of a rear end cover used in the prior art, machining escape holes 31 at a position of the rear end cover is needed. In the embodiment, while the air duct housing 1 is assembled to obtain a complete air duct, machining and forming the escape holes 31 directly at the position of the mounting end cover. Therefore, no additional process of the front end cover 62 is required, which improves an overall production efficiency.

In the embodiment, in order to enhance the strength between the mounting end cover 3 and the fixing part 2, there are some reinforcing ribs 5 disposed at a connecting position between the mounting end cover 3 and the fixing part 2. In addition, in the disclosure, an end of the fixing part 2 far away from the air inlet is disposed outside the air duct housing 1.

The disclosure also provides a motor including the above-mentioned stator structure. Since the motor and the embodiment of the stator structure of the disclosure are based on the same concept, the technical effects are the same. For the specific content, please refer to the description in the embodiment of the stator structure of the disclosure, and there will be no further description here.

For those skilled in the art, it is obvious that the disclosure is not limited to the details of the above exemplary embodiments, and the disclosure can be realized in other specific forms without departing from the spirit or basic features of the disclosure. Therefore, from any points of view, the embodiments should be regarded as exemplary and non-limiting. The scope of the disclosure is limited by the appended claims rather than the above description. Therefore, it is intended to include all changes within the meaning and scope of the equivalent elements of the claims in the disclosure. Any reference numerals in the claims shall not be regarded as limiting the claims involved.

In addition, it should be noted that although this specification is described in terms of embodiments, not every embodiment includes only one independent technical scheme. The description of the specification is only for clarity. Those skilled in the art should take the description as a whole, and the technical schemes in each embodiment can also be appropriately combined to form other embodiments that can be understood by those skilled in the art.

What is claimed is:

1. A stator structure, comprising:

an air duct housing;

a fixing part, coaxially disposed in the air duct housing and configured to install a motor assembly, wherein a first end of the fixing part is provided with a mounting inlet configured to install an end cover;

connecting components, disposed between the air duct housing and the fixing part, and configured to fix a relative position of the air duct housing and the fixing part; and a mounting end cover, disposed on a second end of the fixing part;

wherein a position of the mounting inlet provided by the fixing part is on a same side as a position of a fan blade assembly disposed in the air duct housing;

wherein an inner diameter of the fixing part at the first end is equal to an inner diameter of the fixing part at the second end, and is greater than an inner diameter of the mounting end cover at the second end; and an inner wall of the air duct housing is taken as a first surface configured to install a fan blade assembly, an inner wall of the fixing part is taken as a second surface configured to install a stator assembly, an inner wall of the mounting end cover is taken as a third surface configured to install a bearing, and the first through third surfaces are made in an one-time processing, thereby ensuring coaxiality of the air duct housing, the fixing part and the mounting end cover.

2. The stator structure according to claim 1, wherein the connecting components comprise air deflectors, the air deflectors are arranged in a circular array between the air duct housing and the fixing part.

3. The stator structure according to claim 2, wherein a shape of each of the air deflectors is arc, and the air deflectors are oriented in a same direction.

4. The stator structure according to claim 1, wherein the inner wall of the fixing part is provided with at least one positioning groove extending along an axial direction; and at least one bar-shaped protrusion corresponding to the at least one positioning groove is provided on an outer wall of the stator assembly.

5. The stator structure according to claim 1, wherein the mounting end cover is provided with escape holes for bar-shaped terminals, and the escape holes for bar-shaped terminals are distributed at an outer side of the third surface.

6. The stator structure according to claim 1, wherein the stator structure further comprises reinforcing ribs, the reinforcing ribs are disposed between the mounting end cover and the fixing part.

7. The stator structure according to claim 1, wherein the end of the fixing part extends outward along an axial direction, thereby the mounting end cover is disposed outside the air duct housing.

8. A motor, comprising:

the stator structure according to claim 1;

the motor assembly, disposed in the fixing part; and the fan blade assembly, disposed on an output end of the motor assembly, wherein the fan blade assembly comprises arcuate fan blades and a fan blade housing configured to fix the arcuate fan blades, and the fan blade assembly is disposed in the air duct housing.

9. The motor according to claim 8, wherein an outer wall of the motor assembly is provided with at least one bar-shaped protrusion, the at least one bar-shaped protrusion is snapped with at least one positioning groove.

10. A stator structure, comprising:

an air duct housing, comprising: a first inner wall configured to install a fan blade assembly, and wherein the air duct housing is provided with an air inlet configured to provide external air to the fan blade assembly;

a fixing part, coaxially connected to the air duct housing, wherein the fixing part comprises: a second inner wall configured to install a motor assembly, and a first end of the fixing part is provided with a mounting inlet configured to install an end cover;

a mounting end cover, disposed on a second end of the fixing part, and comprising: a third inner wall configured to install a bearing;

wherein the air inlet of the air duct housing is located on a same side as the mounting inlet;

wherein an inner diameter of the fixing part at the first end is equal to an inner diameter of the fixing part at the second end, and is greater than an inner diameter of the mounting end cover at the second end; and the first through third inner walls are made in a one-time processing, thereby ensuring coaxiality of the air duct housing, the fixing part and the mounting end cover.

11. The stator structure according to claim 1, wherein the end cover comprises: a main portion and an extending portion connected to the main portion; an inner diameter of the extending portion is less than the inner diameter of the fixing part at the first end, the extending portion extends into the fixing part and is in contact with the fixing part, and the main portion is in contact with the first end of the fixing portion.

12. The stator structure according to claim 1, wherein a plurality of reinforcing ribs are disposed between the mounting end cover and the fixing part, and the mounting end cover is provided with escape holes disposed at an outer side of the third surface; and each of the plurality of reinforcing ribs is disposed between adjacent two of the escape holes.

13. The motor according to claim 8, wherein the motor assembly comprises the stator assembly disposed in the fixing part and is contact with the inner wall of the fixing part.

14. The motor according to claim 13, wherein the inner diameter of the fixing part at the first end is greater than an outer diameter of the stator assembly.

15. The stator structure according to claim 10, wherein the end cover comprises: a main portion and an extending portion connected to the main portion; an inner diameter of the extending portion is less than the inner diameter of the fixing part at the first end, the extending portion extends into the fixing part and is in contact with the fixing part, and the main portion is in contact with the first end of the fixing portion.

16. The stator structure according to claim 10, wherein a plurality of reinforcing ribs are disposed between the mounting end cover and the fixing part, and the mounting end cover is provided with escape holes; and each of the plurality of reinforcing ribs is disposed between adjacent two of the escape holes.

* * * * *